US007886922B2

(12) United States Patent
Seelhofer

(10) Patent No.: US 7,886,922 B2
(45) Date of Patent: Feb. 15, 2011

(54) CLOSING DEVICE COMPRISING A NON-CONTINUOUSLY CIRCULAR CUTTING RING

(76) Inventor: Fritz Seelhofer, Haldenstrasse 18, CH-8315 Lindau (CH)

( * ) Notice: Subject to any disclaimer, the term of this patent is extended or adjusted under 35 U.S.C. 154(b) by 360 days.

(21) Appl. No.: 12/223,373

(22) PCT Filed: Jan. 29, 2007

(86) PCT No.: PCT/CH2007/000036

§ 371 (c)(1),
(2), (4) Date: Jul. 29, 2008

(87) PCT Pub. No.: WO2007/085106

PCT Pub. Date: Aug. 2, 2007

(65) Prior Publication Data

US 2009/0020494 A1 Jan. 22, 2009

(30) Foreign Application Priority Data

Jan. 29, 2006 (CH) ..... 0139/06

(51) Int. Cl.
*B65D 41/50* (2006.01)
*B65D 51/22* (2006.01)
*B65D 41/58* (2006.01)

(52) U.S. Cl. ..... 215/297; 215/249; 215/253; 215/257; 220/258.4; 220/278; 222/519; 222/83.5

(58) Field of Classification Search ..... 215/247–249, 215/252, 257, 297; 220/258.4, 267, 277, 220/278; 222/519, 83, 83.5
See application file for complete search history.

(56) References Cited

U.S. PATENT DOCUMENTS 4,483,464 A * 11/1984 Nomura ..... 222/83
5,020,690 A * 6/1991 Kishikawa et al. ..... 222/83
5,147,070 A * 9/1992 Iwamoto ..... 222/83

(Continued)

FOREIGN PATENT DOCUMENTS

WO WO 03045811 A1 * 6/2003

(Continued)

*Primary Examiner*—Anthony Stashick
*Assistant Examiner*—Ned A Walker
(74) *Attorney, Agent, or Firm*—Yi Li

(57) ABSTRACT

The invention relates to a plastic closing device comprising a bottom part, a closing cap, and a cutting ring which is mounted inside the neck of the bottom part so as to be helically movable. A driving cam (16) which is axially disposed in the closing cap acts upon the non-continuously circular cutting ring when the closing cap is unscrewed such that the cutting ring perforates and cuts through the receptacle in a helical cutting movement. The cutting ring forms a ventilating concavity (6) which cooperates with the driving cam (16). The non-circular cutting ring, the bottom side of which is provided with a sharp cutting edge extending at an obtuse angle relative to the bottom edge of said ring, performs a helical cutting movement similar to an advancing knife when the closing cap is unscrewed such that the receptacle wall is easily cut by applying a minimum amount of force because a new sharp point constantly attacks the packaging material, thus preventing shredding. The recess (6) that is provided on the non-circular cutting ring acts as a ventilation duct (26) when the content is poured, obtaining an extremely steady, non-gushing pouring action.

18 Claims, 6 Drawing Sheets

Figure 1:
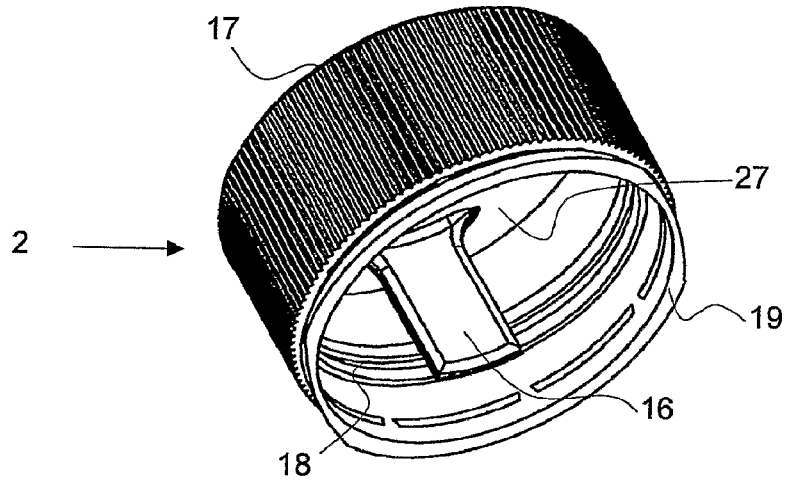

U.S. PATENT DOCUMENTS 5,482,176 A * 1/1996 Maietta et al. ..... 220/277
5,947,318 A * 9/1999 Palm ..... 220/278
5,960,992 A * 10/1999 Bernstein et al. ..... 222/83.5
6,364,164 B1 * 4/2002 Troiano ..... 222/83
6,382,462 B1 * 5/2002 Ostergaard-Nielsen et al. . 222/1
6,450,367 B1 * 9/2002 Sittler ..... 222/39
6,477,743 B1 * 11/2002 Gross et al. ..... 222/525
6,571,994 B1 * 6/2003 Adams et al. ..... 222/521
6,851,576 B2 * 2/2005 Dubach ..... 222/83
7,178,683 B2 * 2/2007 Birkmayer et al. ..... 215/257
7,207,465 B2 * 4/2007 Weist ..... 222/83
7,261,226 B2 * 8/2007 Adams et al. ..... 222/521
2005/0242113 A1 * 11/2005 Weist ..... 222/83.5
2006/0071000 A1 * 4/2006 Weist et al. ..... 220/278

FOREIGN PATENT DOCUMENTS

WO WO 2005073098 A1 * 8/2005
WO WO 2009111899 A1 * 9/2009

* cited by examiner

CLOSING DEVICE COMPRISING A NON-CONTINUOUSLY CIRCULAR CUTTING RING

This invention relates to a multipart plastic closing device comprising a closing cap, a bottom part and a non-continuously circular cutting ring as the central element, and which is attachable over a predetermined opening position of a closed receptacle or at the top of a bottle.

Various receptacles are available on the market for the storage of flowable media in which, before they are opened, a membrane, foil or even the packaging wall itself must be pierced before the liquid medium can be removed from the receptacle. Such receptacles may be soft packs made from multiple ply card or foils onto which a closing device is bonded or welded. They may also, however, be bottles with a threaded or snap-on top in which a foil seals the top of bottle, said foil then having to be cut. Typical closing devices for such types of packaging have a bottom part with a cylindrical pouring spout and external thread as well as a lower edge-standing flange for fastening to the soft pack. Before the contents can be removed from the receptacle the closing cap must be unscrewed from the bottom part in order to then sever the receptacle wall in the region of the pouring spout. The opening of the receptacle wall at the predetermined opening position may be effected by finger pressure on the integrated piercing device, the drawback of this being, however, that the pouring characteristics of such closures are poor and the risk of contaminating the liquid is great because the finger comes into contact with the liquid. Another way of opening the receptacle wall is with the aid of the closing cap to press a piercing device down through the packaging material. Here the closure must first be closed completely in order to move the piercing device provided in the pouring spout of the bottom part downwards, thereby opening the soft pack. In order to be able to pour out the liquid contents, the closing cap be fully screwed down in a third step. This opening mechanism has not become generally accepted in practice, as its handling is too complicated. Piercing devices are also known which co-operate interactively with a closing cap such that when the screw cap is screwed down the piercing device is simultaneously moved so that same is moved downwards and pierces the packaging wall. The severed part of the packaging wall remains suspended to the piercing device because the latter must be adhesively fixed to the packaging wall. The piercing device itself remains in the closing cap and is taken out with it during opening. The frequent opening and closing of the closing cap can easily cause multiple contamination of the contents to take place. In addition, it is tricky and expensive to assemble this device. As the piercing device has to be stuck to the receptacle wall, the correct metered amount of adhesive is crucial to the successful initial opening of the packaging material.

In the region of the piercing soft packs have a pre-stamped predetermined opening position, enabling the piercing device to effect complete severance with little expenditure of force. This tricky stamping is often inadequately executed, with the result that the requisite force to be exerted by the piercing device is very great. Accordingly the thread on the cylindrical bottom part and on the inner surface of the shell wall of the closing cap has to be strong, i.e. equipped with great thread depth, which requires a more robust construction with increased wall thickness and hence a greater material requirement. The force required for initial operation of the closing cap is therefore so great because the whole force for the translatory axial motion of the piercing device is applied only by the rotational movement of the closing cap. In some closures with piercing devices the internal thread on the closure connection is soft ejected. However such threads cannot have any great depth and therefore also do not transfer great axial forces. In other solutions the piercing device is first pressed downwards by elements provided on the underside of the cover of the closing cap during the unscrewing of same, so that a cutting element pierces an underlying foil and after that the piercing device is still turned. By the time rotation is completed and the foil is cut, the closing cap has in the meantime been screwed loose from the end thread and can be removed. When the closing cap is again screwed down, the piercing device is first pushed a bit further downwards because the closing cap with the elements on the underside of its top cover presses on the piercing device during screwing down. This calls for a corresponding expenditure of force when initially screwing down the closure, and consumers complain it is unpleasant.

The object of the present invention is firstly to create a closing device in which the force for opening is less, and secondly to guarantee extremely exact, sharp, knife-like cutting of the soft packaging or the foil on a receptacle end in the region of the predetermined opening position, and another object of the invention is at all times to guarantee the steady, non-gushing pouring behaviour of the liquid contents. Finally, an object of the invention is with such a closing device to be able to meter in a separate substance, even a sensitive substance, by opening the contents of a receptacle.

These objects are achieved by a multipart closing device with the features of claim 1.

Various exemplary embodiments of this closing device will now be explained with the aid of the drawings and their function described in detail.

Figure 2:
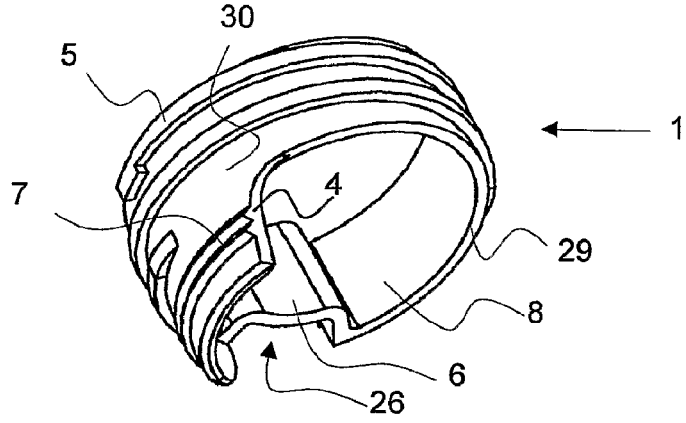
Figure 3:
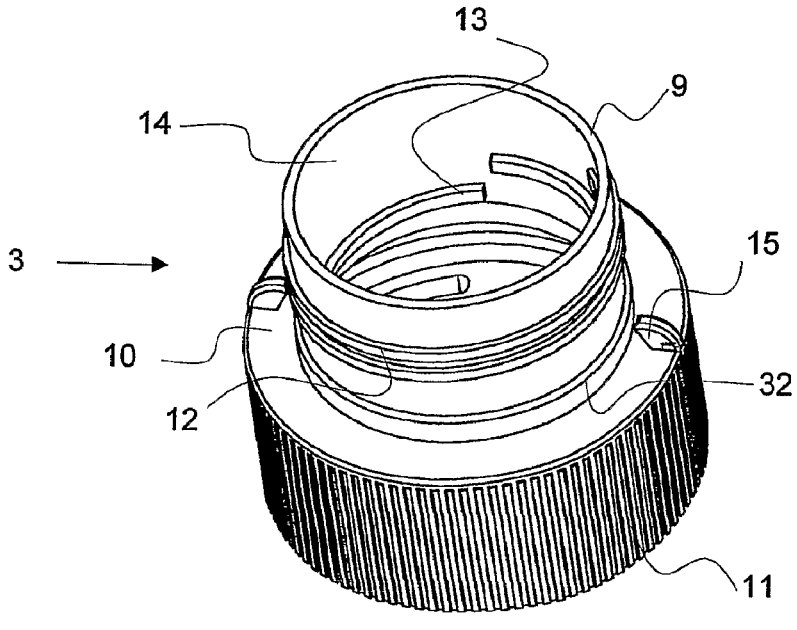
Figure 4:
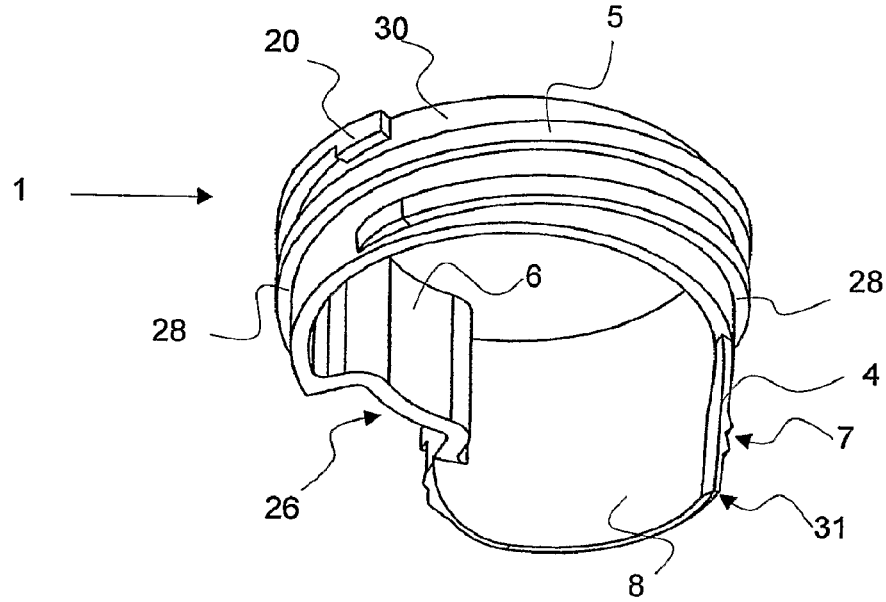
Figure 5:
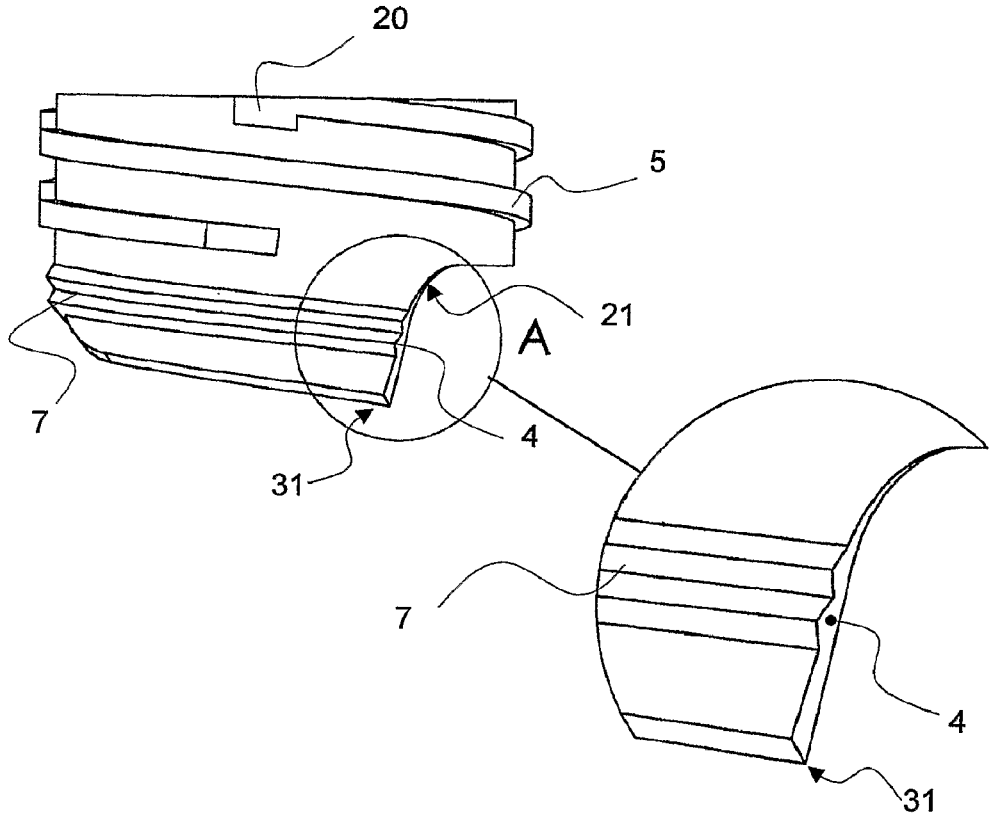
Figure 6:
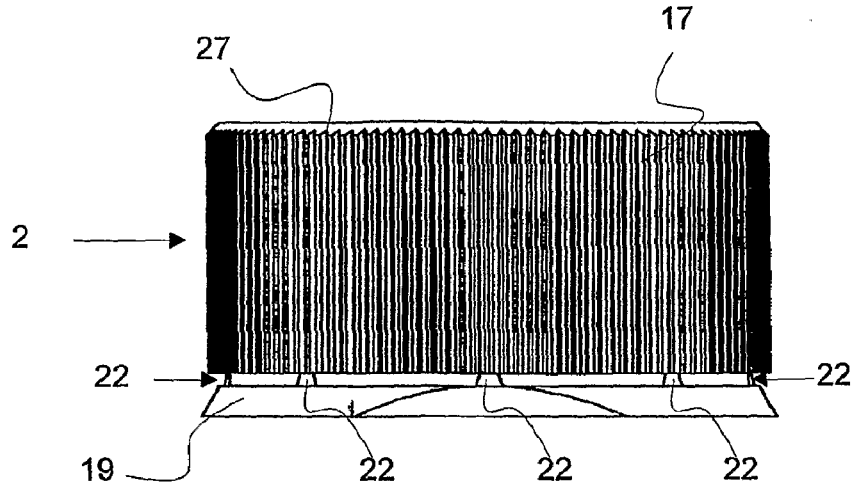
Figure 7:
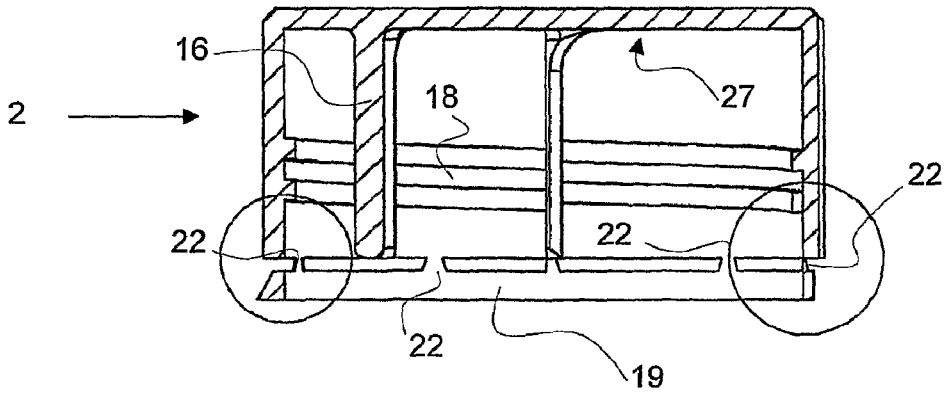
Figure 8:
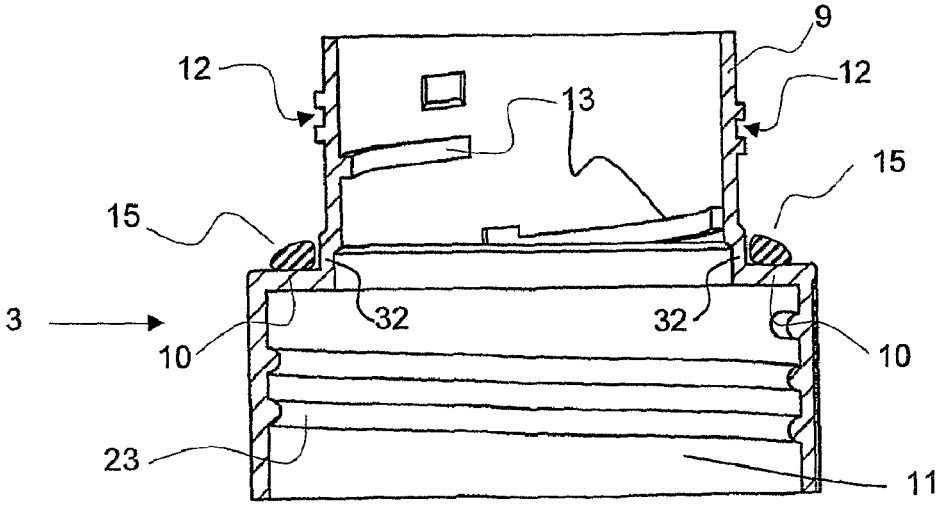
Figure 9:
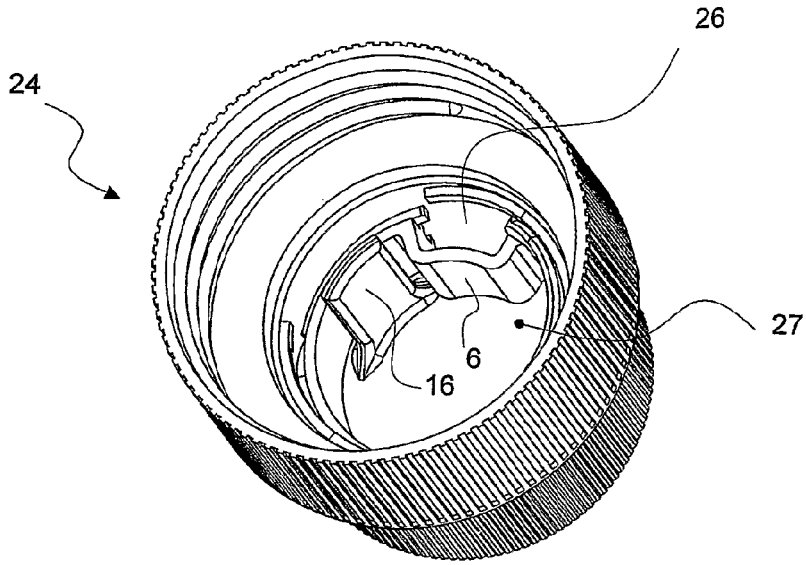
Figure 10:
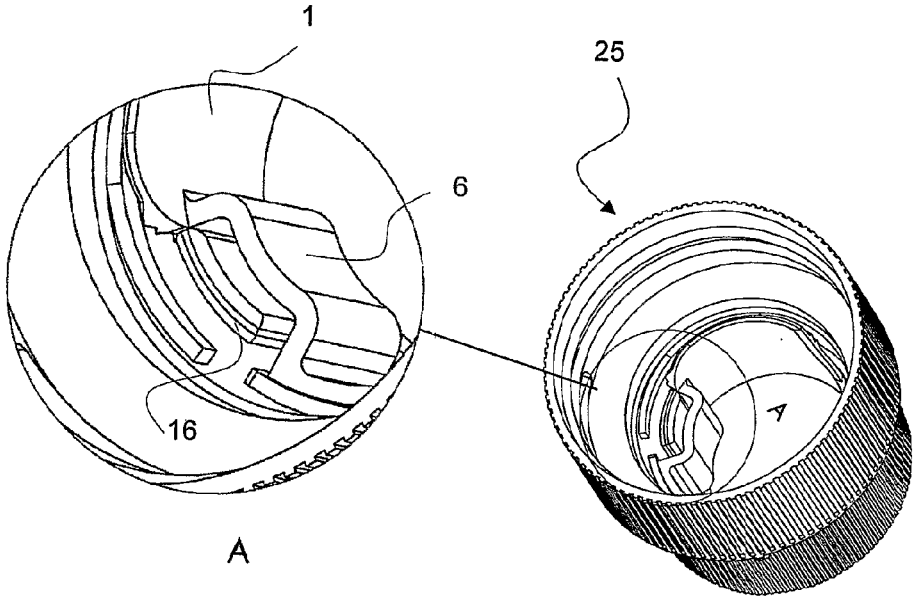
Figure 11:
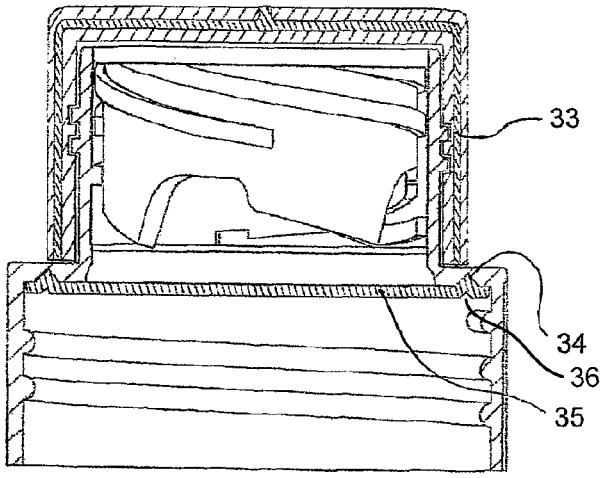
Figure 12:
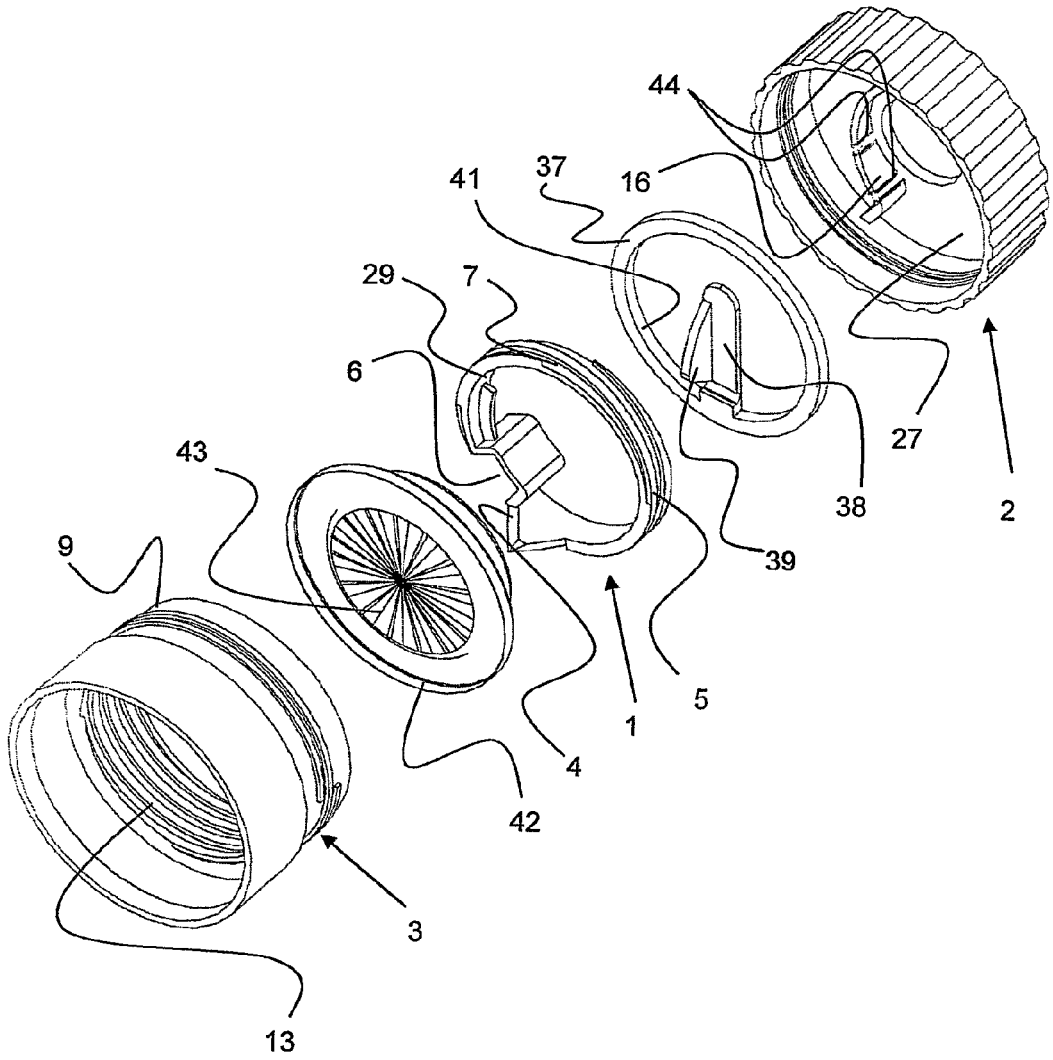

Shown are:

FIG. 1: the closure cap cover with the driving cam and tamper-evident band in a perspective view seen obliquely from below;

FIG. 2: the non-continuously circular cutting ring in a perspective view seen obliquely from below;

FIG. 3: the bottom part with pouring spout and threaded or impact flange in a perspective view seen obliquely from above;

FIG. 4: a detail perspective view of the non-continuously circular cutting ring seen obliquely from below;

FIG. 5: the non-continuously circular cutting ring with angled cutting edge viewed horizontally from the side with a detail view of the sharp cutting edge;

FIG. 6: The closing cap with attached tamper-evident band viewed horizontally from the side;

FIG. 7: The closing cap in diametrical vertical section viewed from the side;

FIG. 8: The bottom part with pouring spout and threaded flange in a diametrical vertical section viewed from the side;

FIG. 9: The complete closing cap comprising top part, non-continuously circular cutting ring and bottom part in a perspective view seen obliquely from below, in the "external" design variant;

FIG. 10: The complete closing cap comprising top part, non-continuously circular cutting ring and bottom part in a perspective view seen obliquely from below, in the "internal" design variant;

FIG. 11: A variant of the closing cap with a barrier layer in the closing cap and the bottom of the end shoulder, for the formation of a hermetically sealed metering receptacle inside the closing cap;

FIG. 12: A representation of the individual parts of a special closing device for the opening of a foil capsule and for the automatic addition of a substance or tablet enclosed therein.

The three main components of the closing device are represented in FIGS. 1 to 3. FIG. 1 shows the top part, the closing cap 2, in a perspective view seen obliquely from below. It comprises the closing cap cover 27 and the shell wall 17. On the inner closing cap cover 27 is provided an axially running driving cam 16, the geometry of which corresponds to the recess 6 on the cutting ring 1, said recess 6 interrupting the otherwise circular cutting ring 1 so that it can be described as a non-continuously circular cutting ring 1. On the one hand the driving cam 16 engages positively with the recess 6 and thus its inner side fits against the external wall 30 of the cutting ring 1. On the other hand, inside the cylindrical cutting ring 1 fitting against the inner wall 8 thereof the driving cam 16 can also act as a stop at the recess 6. The core part of the closing device according to the invention is the cutting ring 1, which in FIG. 2 is represented in a perspective view seen obliquely from below. The cylindrical cutting ring 1 is open above and below in an axial direction and has as an important feature a recess 6 which extends in an axial direction over the full height of the cutting ring 1. At this point it interrupts the cutting ring, so that the latter is not continuously circular. When the package contents are subsequently poured, this recess 6 forms an ventilation duct 26 and co-operates with the driving cam 16 in such a manner that same either acts as a driver when it engages in the recess 6, or as a stop when the driving cam 16 hits the recess 6 from the inside of the ring 1. Another important feature of the cylindrical cutting ring 1 is a sharp cutting edge 4 which encloses an obtuse angle with the bottom edge 29 of the cutting ring 1. The function of the cutting edge 4 and the guide grooves 7 attached to it in a horizontal direction will be covered in more detail below. Moulded to the cylindrical outer wall of the cutting ring 1 are helically-shaped guide segments 5 which co-operate with the guide curve segments 13 moulded to the cylindrical pouring spout 9 and mesh into each other. FIG. 3 is a perspective view, seen obliquely from above, of the bottom part 3 of the closing device according to the invention with pouring spout 9 and threaded- or impact flange 10 in alignment integrally moulded to the bottom edge. In a variant not shown here the flange 10 may also be of flat design, so that fixing is effected either by welding or bonding to the outside or inside of a soft pack, in the latter case with the bottom part 3 passing through the already existing opening from below. In these above two variants a separate membrane or foil is then provided which has to be cut through. In a further variant the bottom part 3 may also constitute an integral component of the receptacle. In this case, therefore, the bottom part 3 corresponds to an appropriately formed receptacle neck, of a bottle for example. The outside of the cylindrical end 9 has an external thread 12 which co-operates with the internal thread 18 of the closing cap 2 so that the cylinder end 9 can be sealed shut by the closing cap 2 and reopened by the consumer rotating the shell wall 17. During the first unscrewing movement of the closing cap 2 the driving cam 16 acts on the non-continuously circular cutting ring 1 in such a manner that the latter is rotated downwards in a helical movement. At the same time the guide segments 5 slide on the guide curve segments 13 provided on the cylindrical inner wall 14, said curve segments not constituting a continuous unbroken thread, thus greatly reducing the friction. A further advantage of these guide curve segments 13 is that the bottom part 3 can easily be ejected with staggered cores in a mould, which means that sharp edges on the guide curve segments 13 are feasible and hence a more accurate fit with the cutting ring 1, as the edges cannot be long drawn by forced ejection as with other solutions.

FIG. 4 shows important features of the cutting ring 1 in a perspective detail view seen obliquely from below. The guide segments 5 running helically around the cylindrical outer wall 30 with their sharp guide flanks 28 and the stop cam 20 are clearly visible, with the latter delimiting the translatory axial movement of the ring 1. In this representation the axial recess 6 illustrates its two ranges of action, namely that of a stop and driver respectively and that of an ventilation duct 26 when the contents of a pack fitted and opened with this closing device are poured out. An additional advantage of the recess 6 is that an unequivocal position of the ring 1 is always ensured when tracing in the assembly process.

FIG. 5 shows the cutting ring 1 seen horizontally from the side with a detail view of the sharp cutting edge 4. The blade 4 solution is different to that in known systems, in that the cutting angle 21 is designed to be greater than 90°, which guarantees an extremely stable cutting process. During the initial unscrewing of the closing cap 2 the cutting ring is moved helically downwards by means of the driving cam 16. At the same time the lowest, sharp corner edge 31 scrapes a packaging material or foil and, as rotation increases, plunges into the packaging material or foil and pierces same. In the further course of the helical downward movement of the ring 1, the sharp edge 4 moves along the packaging material or foil, which means a considerably reduced force in the opening process by contrast with state-of-the-art solutions, for at no stage of the cutting process does a particularly great force or a particularly high torque need to be built up. The cutting edge 4 moving downwards in a helical movement is comparable to a moving blade and results in the sharp edge 4 continuously, easily and with little force cutting the packaging material or foil with a new, fresh and therefore sharp place, thus avoiding rough fraying of the cutting position and producing a clean cut. On the outer wall 30 of the cutting ring 1 with recess 6, starting from the sharp cutting edge 4, are provided guide grooves 7 which serve to guide and smooth the severed packaging material or severed foil, which supports the accurate, clean and sharp cutting process. The cutting system according to the invention results in an altogether greatly reduced expenditure of force during opening, i.e. when piercing a packaging material or foil, there being a considerably reduced load on the adhesion area of a closing device bonded to a laminated card brick pack, thus minimising the risk of same becoming detached from the pack. As a consequence of this reduction in force the closing device according to the invention can be realised as a robust but lighter construction with reduced wall thickness, which is equivalent to a saving of 1-3 grams per unit. For production of $10^6$-$10^9$ pieces a year this gives material savings in the order of 1-3,000 tonnes of plastics.

In an embodiment not shown here the external thread 12 of the pouring spout 9 is merely designed as a fine thread because, in comparison to state-of-the-art solutions, the axial forces occurring during the advance of the non-continuously circular cutting ring 1 need not be absorbed by the closing cap 2 and hence the threads 12, 18 between the closing cap 2 and the bottom part 3 remain virtually unstressed. Between the external thread 12 and the flange 10 is moulded at the bottom of the pouring spout 9 an annular stop bead 32 which absorbs the acting forces when the closing cap 2 is brought onto the bottom part 3—i.e. the closing cap can be directly pressed down, i.e. scraped, until it hits the stop bead 32.

FIG. 6 shows the aforementioned closing cap 2 comprising top cover 27 and shell wall 17 viewed horizontally from the side, in this representation showing the tamper-evident band 19 moulded with fine connections 22 to the bottom edge of the shell wall 17.

In FIG. 7 the closing cap 2 is shown in a diametrical vertical section viewed from the side. The driving cam 16 is provided on the inner closing cap cover 27 and points axially downward, in order during the initial opening of the closing cap 2 to engage in or on the ventilating concavity 6 of the non-continuously circular cutting ring 1, giving the latter the helically downwardly directed cutting drive, the fine connections 22 between tamper-evident band 19 and shell wall 17 also being simultaneously torn. In the version shown here the positive-fit means is executed as a simple internal thread which co-operates with the external thread 12 present on the cylindrical pouring spout 9. In the device according to the invention the force exerted on the tamper-evident band is not added to the force acting on the cutting ring 1 with recess 6, which is why the positive-fit means 12, 18, as already mentioned, can also be designed as a fine thread so that the closing cap 2 can be scraped onto the pouring spout 9 without a rotary movement having to be executed.

FIG. 8 shows the bottom part 3 with pouring spout 9 and threaded flange 10 in a diametrical vertical section viewed from the side. Clearly visible here are the guide curve sections 13 which are moulded to the inner wall of the pouring spout 9 and which co-operate with the guide segments 5 on the cutting ring 1. The guide curves on the inside of the spout 9 are not continuously executed, but deliberately executed merely as guide curve segments 13. During manufacture this facilitates the ejection of this bottom part 3 of the closing device by allowing a slider to be dispensed with. Moreover, the friction between cutting ring 1 and pouring spout 9 is minimised by the non-continuous thread. A great advantage of this version is also that the bottom part 3 can easily be ejected by means of staggered cores in a moulding, which results in sharp edges on the guide curve segments 13 and hence in a more accurate fit with the helical guide segments 5 on the cutting ring 1. The internal thread 23 on the thread wall 11 of the flange 10 shown in FIG. 8 can also be designed as an impact thread, adapter or adherent area, making it possible to equip very different receptacles. The thread wall 11 can also be an integral component of the receptacle itself, which means that the bottom part is moulded to the neck of the receptacle, with a membrane or film then being provided which must be severed. The rotary motion of the aforementioned tamper-evident band 19 is prevented at the stops 15 and the connections 22 acting as predetermined breaking pieces are separated.

FIG. 9 shows the complete closing device 24 comprising top part 2, cutting ring 1 with recess 6 and bottom part 3 in a perspective view seen obliquely from below, the axial driving cam 16 here engaging outside the recess 6, i.e. inside the cutting ring 1, and providing the latter as a stop with the necessary drive during the corresponding unscrewing movement of the closing cap. The duct 26 defined by the recess 6 here serves as a ventilation duct and, once the receptacle has been cut through, guarantees the steady non-gushing pouring of the contents.

FIG. 10 shows the complete closing device 25 comprising top part 2, cutting ring 1 and bottom part 3 in a perspective detail view seen obliquely from below, here with the axial driving cam 16 engaging inside the recess 6, i.e. outside the cutting ring 1, and providing the latter with the necessary drive as in the example above, the actual helical downward movement of the cutting ring 1 in both examples being effected by the co-operation of the guide segments and guide curve segments 13 provided respectively on the outside of the outer cutting ring 1 and the inside of the pouring spout.

FIG. 11 shows a special version of the closing device, which here simultaneously forms a hermetically sealed receptacle for receiving a separate metering component, for example of a powder, liquid or granulate. This receptacle is therefore even ultra-tight, even oxygen-tight. For this purpose the closing cap contains a barrier layer 33 inserted in the course of injection moulding. Such a internal layer can be produced while two different components are being moulded in a simultaneous injection process, for example an even oxygen-tight EVOH inside and, for example, a polyolefin outside. On the underside of the spout shoulder is circularly recessed a groove 34 of V-form cross-section. In the assembled and upturned state the closing device is filled with the metering component, essentially the inner part of the spout being available for this, though the cutting ring 1 takes up some space. In this upturned position the nozzle is sealed by the cap from below. It may, however, be filled from the top. After filling, on top of the inside of the spout shoulder, namely over groove 34, is sealed a barrier layer foil 35. Running around the external edge region this has a groove 36 of V-shaped cross-section. The diameter of this groove 36 over the diameter of the disk-shaped barrier layer foil 35 measures just less than the diameter of the V-shaped circular groove 34 at the spout shoulder. When the barrier layer foil 35 is pressed on in the course of sealing it is therefore everywhere stretched in a radial direction and sealed in this pretensioned state. This measure facilitates the subsequent piercing and cutting of this barrier layer foil 35 by means of the cutting ring 1. The receptacle formed is entirely surrounded by a barrier layer which can be oxygen-tight, so that even ultra-sensitive metering substances such as vitamins etc., for example, may be enclosed in this manner.

FIG. 12 shows a further embodiment of this closing device. This makes it possible in the course of the initial opening process to first open a foil capsule 42 housed in the bottom part 3 with the substance contained therein, for example in the form of a tablet 43, and afterwards to add the substance or tablet automatically to the receptacle contents. To do this the foil capsule 42 is cut open in the course of initial opening and then in the inside of the closing device immediately swung downwards so that the tablet 43 contained inside it falls downwards into the receptacle fitted with the closure. For this purpose is inserted between the closing cap 2 and the cutting ring 1 a ring 37 with a movable tongue which is movably moulded to the inner ring edge 41 and points into the centre of the ring. In an alternative version said ring may also be moulded to the upper side of the spout 9 on the bottom part 3. On its underside the movable tongue has a downward projecting pusher rib 39. The driving cam 16 on the closing cap cover 27 runs out in a falling guide curve starting from cam level. When the closing cap 2 is unscrewed this guide curve acts on the movable tongue 38 at the ring 37, so that said tongue is swung steadily downwards by the rotation of the closing cap 2. As shown here, said guide curve may be a spiral-shaped inward-leading rib provided on the inside of the closing cover 27, it being guided at the higher end by way of a radial section on the inner wall of the closing cap 2. Immediately joining to this section the rib has two notches 44, so that between same is formed a driving cam 16 which engages in the recess 6 on the associated cutting ring 1. A foil capsule 42 with a substance or tablet 43 enclosed therein is snapped into the bottom part 3 from below, so that the foil capsule 42 in the bottom part 3 is wedged between the bottom part 3 and the bottle neck fitted with the bottom part 3 and thus held fast. The figure shows the foil capsule 42, though above the bottom part 3. This makes it easier to understand how during its rotation the cutting element with the cutting edge 4 cuts the foil capsule 42 along its circumferential edge from above, and not only the top foil but the bottom foil as well. The outer edge of the foil capsule is thus fully opened. Simultaneously with cutting, the movable tongue 38 begins pressing on the foil capsule 42 from above with its pusher rib 39, so that the foil capsule 42 is swung downwards inside the bottom part 3. Finally the opening of the foil capsule edge and the swinging down of the foil capsule 42 has progressed to the extent that the substance or tablet 43 slips out through the opening produced in the foil capsule 42 and drops down.

The great advantage of the solution according to the invention is the novel cutting mechanism of the sharp cutting edge 4, the edge of which is guided like a moving blade at an obtuse angle along the packaging material, as well as the minimisation of the torque applied, because here the screwing motion is obtained by the perfectly attuned co-operation of cutting ring with recess and bottom part. The recess 6 on the cutting ring 1 forms an ventilation duct 26 which results in the steady, non-gushing pouring of the liquid contents.

The invention claimed is:

1. A multipart plastic closing device attachable over a receptacle, comprising a bung-shaped bottom part (3) with a cylindrical pouring spout (9) which is connected or connectable to the receptacle, and a closing cap (2) having a top cover and a cylindrical skirt extending downward from the top cover, the closing cap sealingly placeable on the spout (9) of the bottom part (3), as well as a cylindrical cutting ring (1) which is open on both sides in an axial direction and is helically movably provided in the spout (9) of the bottom part (3), within the closing cap (2) there being at least one axial driving cam extending downward from the top cover, separately from the cylindrical skirt, the at least one axial driving cam acting on the cutting ring (1) during an unscrewing movement of the closing cap (2), characterised in that the cutting ring (1) has a cylindrical outer wall (30) that is not continuously circular, and has at least one axial recess (6) disposed in the cylindrical outer wall (30), thereby forming a non-continuously circular cutting ring; the axial recess cooperates as a driver with the at least one axial driving cam (16) when said at least one axial driving cam engages within the axial recess (6), or as a stop when from inside the cutting ring (1) and outside the recess (6) the at least one axial driving cam engages the cutting ring, as a result of which the cutting ring (1), during an unscrewing movement of the closing cap (2) due to positively fitting means (5, 13) moulded to an inner wall of the cylindrical pouring spout (9) of the bottom part (3) and to an outside of the cutting ring (1), is displaceable into a helical downward-leading movement during an initial unscrewing movement of the closing cap (2), and that the underside of the cutting ring (1) has a sharp cutting edge (4) extending from a bottom edge (29) of the cutting ring (1) and having an obtuse angle (21) relative to the bottom edge (29), and that the at least one axial recess (6) on the cutting ring (1) acts as a ventilation duct (26) when the contents are poured out.

2. The closing device according to claim 1, characterised in that the cylindrical pouring spout (9) of the bottom part (3) is formed with an external thread (12) and with a lower edge-standing flange (10), the flange (10) having an inner or outer impact thread (23) for attachment to a receptacle, and that the pierceable place is either a membrane or a region of a receptacle wall positioned below a pouring opening left free by the bottom part (3).

3. The closing device according to claim 1, characterised in that the cylindrical pouring spout (9) of the bottom part (3) is formed with an external thread (12) and with a lower edge-standing flat flange (10) for attachment by means of adhesive or by welding to a soft pack, and that the pierceable place is a membrane or region of a receptacle wall below a pouring opening left free by the bottom part (3).

4. The closing device according to claim 1, characterised in that the bottom part (3) is an adapter which is placeable on a membrane-sealed neck of a receptacle and has a part forming the pouring spout (9) which extends upwards over the neck of the receptacle.

5. The closing device according to claim 1, characterised in that the bottom part (3) is formed as part of a receptacle itself, with the closing cap containing a barrier layer (33) introduced in the course of injection moulding, and that on an underside of a spout shoulder a circular groove (34) of V-shaped cross-section is recessed, and after filling a component inside the pouring spout (9) a barrier layer foil (35) is pre-tensioned and sealed over the groove (34) to seal the component therein.

6. The closing device according to claim 1, characterised in that the bottom part (3) and the non-continuously circular cutting ring (1) are two separately fabricated parts, and that on the cylindrical outer wall (30) of the non-continuously circular cutting ring (1) a helically-formed projecting guide segment (5) and on the inner wall (14) of the pouring spout (9) projecting helically-formed guide curve segments (13) are provided as the positive fitting means, with the guide segment (5) and guide curve segments (13) meshing together when twisted against each other.

7. The closing device according to claim 1, characterised in that for rotation of the non-continuously circular cutting ring (1) the at least one axial driving cam (16) either fastens as a limit stop outside the axial recess (6) on a cylindrical inner wall (8) of the non-continuously circular cutting ring (1), or as a driver inside the axial recess (6) engages with the cylindrical outer wall (30) of the non-continuously circular cutting ring (1).

8. The closing device according to claim 1, characterised in that the sharp cutting edge (4) has two different effective ranges, including a perforation range in the form of a sharp angled edge (31) and connected thereto a cutting range of the sharp cutting edge (4), with a result that a cut receptacle wall or membrane is cut completely and without rough fraying by a helical movement of the cutting edge (4) at an obtuse angle (21) as of a moving blade in a region of a pouring opening, thus minimising axial force effect and torque.

9. The closing device according to claim 1, characterised in that the bottom part (3) and the non-continuously circular cutting ring (1) are integrally injection moulded in an axially aligned arrangement and are held together by predetermined breaking points, and on an outer side of the cutting ring (1), starting from the sharp cutting edge (4), are provided guide grooves (7) for guidance and smoothing of a severed receptacle.

10. The closing device according to claim 1, characterised in that either between the closing cap (2) and the non-continuously circular cutting ring (1) is inserted a ring (37) with a movable tongue (38) which is movably moulded to an inner ring edge (41), points into a ring center and has a downward projecting pusher rib (39), or said ring (37) is moulded onto an upper side of the spout (9) on the bottom part (3), and that to the axial driving cam (16) on the closing cap cover (27) is moulded a guide curve falling from cam height which, when the closing cap (2) is unscrewed, acts from above on the movable tongue (38), and that a foil capsule (42) with a substance or tablet (43) enclosed therein is snapped into the bottom part (3) from below, so that when the closing cap (2) is rotated the cutting ring (1) cuts the foil capsule (42) almost completely around its edge and the movable tongue (38), moving simultaneously, swings the foil capsule (42) downwards so that the substance or tablet (43) falls down through cut edge of the foil capsule (42).

11. The closing device according to claim 10, characterised in that the cylindrical pouring spout (9) of the bottom part (3) is formed with an external thread (12) and with a lower edge-standing flange (10), the flange (10) having an inner or outer impact thread (23) for attachment to a receptacle, and that the pierceable place is either a membrane or a region of a receptacle wall positioned below a pouring opening left free by the bottom part (3).

12. The closing device according to claim 10, characterised in that the cylindrical pouring spout (9) of the bottom part (3) is formed with an external thread (12) and with a lower edge-standing flat flange (10) for attachment by means of adhesive or by welding to a soft pack, and that the pierceable place is a membrane or region of a receptacle wall below a pouring opening left free by the bottom part (3).

13. The closing device according to claim 10, characterised in that the bottom part (3) is an adapter which is placeable on a membrane-sealed neck of a receptacle and has a part forming the pouring spout (9) which extends upwards over the neck of the receptacle.

14. The closing device according to claim 10, characterised in that the bottom part (3) is formed as part of a receptacle itself, with the closing cap containing a barrier layer (33) introduced in the course of injection moulding, and that on an underside of a spout shoulder a circular groove (34) of V-shaped cross-section is recessed, and after filling a component inside the pouring spout (9) a barrier layer foil (35) is pre-tensioned and sealed over the groove (34) to seal the component therein.

15. The closing device according to claim 10, characterised in that the bottom part (3) and the non-continuously circular cutting ring (1) are two separately fabricated parts, and that on the cylindrical outer wall (30) of the non-continuously circular cutting ring (1) a helically-formed projecting guide segment (5) and on the inner wall (14) of the pouring spout (9) projecting helically-formed guide curve segments (13) are provided as the positive fitting means, with the guide segment (5) and guide curve segments (13) meshing together when twisted against each other.

16. The closing device according to claim 10, characterised in that for rotation of the non-continuously circular cutting ring (1) the at least one axial driving cam (16) either fastens as a limit stop outside the axial recess (6) on a cylindrical inner wall (8) of the non-continuously circular cutting ring (1), or as a driver inside the axial recess (6) engages with the cylindrical outer wall (30) of the non-continuously circular cutting ring (1).

17. The closing device according to claim 10, characterised in that the sharp cutting edge (4) has two different effective ranges, including a perforation range in the form of a sharp angled edge (31) and connected thereto a cutting range of the sharp cutting edge (4), with a result that a cut receptacle wall or membrane is cut completely and without rough fraying by a helical movement of the cutting edge (4) at an obtuse angle (21) as of a moving blade in a region of a pouring opening, thus minimising axial force effect and torque.

18. The closing device according to claim 10, characterised in that the bottom part (3) and the non-continuously circular cutting ring (1) are integrally injection moulded in an axially aligned arrangement and are held together by predetermined breaking points, and on an outer side of the cutting ring (1), starting from the sharp cutting edge (4), are provided guide grooves (7) for guidance and smoothing of a severed receptacle.

* * * * *